US006471546B1

(12) United States Patent
Zhu et al.

(10) Patent No.: US 6,471,546 B1
(45) Date of Patent: Oct. 29, 2002

(54) ELECTRICAL CONNECTOR

(75) Inventors: ZiQiang Zhu, Kun Shan (CN); Guohua Zhang, Kun Shan (CN); Lunsong Hu, Kun Shan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/493,028

(22) Filed: Jan. 27, 2000

(30) Foreign Application Priority Data

Dec. 17, 1999 (TW) ..... 88221557 U

(51) Int. Cl.[7] ..... H01R 13/648
(52) U.S. Cl. ..... 439/607; 439/668
(58) Field of Search ..... 439/607–610, 439/668, 669

(56) References Cited

U.S. PATENT DOCUMENTS 4,842,554 A * 6/1989 Cosmos et al. ..... 439/609
4,908,335 A * 3/1990 Cosmos et al. ..... 439/609
5,178,562 A * 1/1993 Ermini ..... 439/609
5,928,035 A * 7/1999 Jankowsky et al. ..... 439/607
5,984,727 A * 11/1999 Wu et al. ..... 439/607
5,993,257 A * 11/1999 Maruyama ..... 439/607
5,993,258 A * 11/1999 Matsunuma et al. ..... 439/607
6,007,379 A * 12/1999 Michaelis et al. ..... 439/607

* cited by examiner

*Primary Examiner*—Gary Paumen
(74) *Attorney, Agent, or Firm*—Wei Te Chung

(57) ABSTRACT

An electrical connector of the present invention for receiving a mating connector plug comprises an insulative housing, a shield covering a front of the insulative housing, and a terminal group received in the insulative housing for electrically connecting with the plug. The insulative housing has a front surface, and a pair of recesses in a pair of sidewalls. Each recess defines an inner wall and a bottom face. The shield comprises a front surface and a pair of securing tabs formed in a pair of side plates. Each securing tab has a pair of tines on the end. A distance from a front of each tine to a rearward side of the shield front surface is not more than the distance from the inner walls to the front surface of the insulative housing. In assembly, the tines of the securing tabs are bent into the corresponding recesses to securely engage with the inner walls and the bottom faces of the insulative housing.

2 Claims, 7 Drawing Sheets

ELECTRICAL CONNECTOR

BACKGROUND OF THE INVENTION

The present invention relates to an electrical connector, and particularly to an electrical connector having a securing tab on a shield.

A conductive shell is often mounted on an outside of an electrical connector for shielding the electrical connector from EMI. U.S. Pat. Nos. 5,178,562; 4,842,554; and 4,908,335 disclose a type of shell used with electrical connectors. Referring to FIGS. 5, 6A and 6B, an electrical connector comprises an insulative housing 9 having several grooves 91 (only one is shown), and a shell 8 having a corresponding number of clipping patches 81 (only one is shown) to interengage with the grooves 91. Each groove 91 further defines a side plane 911 and a bottom plane 912. In assembly, the insulative housing 9 can be inserted into the shell 8, then the clipping patches 81 can be inserted in the corresponding grooves 91 until the clipping patches 81 engage with the bottom planes 912 of the grooves 91. Because the engagement of the clipping patches 81 and the grooves 91 generally consists only of the engagement of the clipping patches 81 and the bottom planes 912, and the side planes 911 generally do not engage with the clipping patches 81, the engagement of the clipping patches 81 and the grooves 91 is not very stable. This can lead to disengagement of the insulative housing 9 from the shell 8, or even removal of the shell 8 from the housing 9. The shield against EMI is therefore not reliable. Hence, an improved electrical connector is required to overcome the disadvantages of the prior art.

BRIEF SUMMARY OF THE INVENTION

An object of the present invention is to provide a shield which can be reliably assembled with a housing to improve the shielding against EMI.

Accordingly, an electrical connector of the present invention for receiving a mating connector plug comprises an insulative housing, a shield covering an outside of the insulative housing, and a terminal group received in the insulative housing for electrically connecting with the plug. The insulative housing has a front surface and a pair of recesses in a pair of sidewalls. Each recess defines an inner wall and a bottom face. The shield comprises a front surface and a pair of securing tabs formed in a pair of side plates. Each securing tab has a pair of tines on the end. A distance from a front of each tine to a rearward side of the shield front surface is not more than the distance from each inner wall to the front surface of the insulative housing. In assembly, the tines of the securing tabs are bent into the corresponding recesses to securely engage with the inner walls and the bottom faces of the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
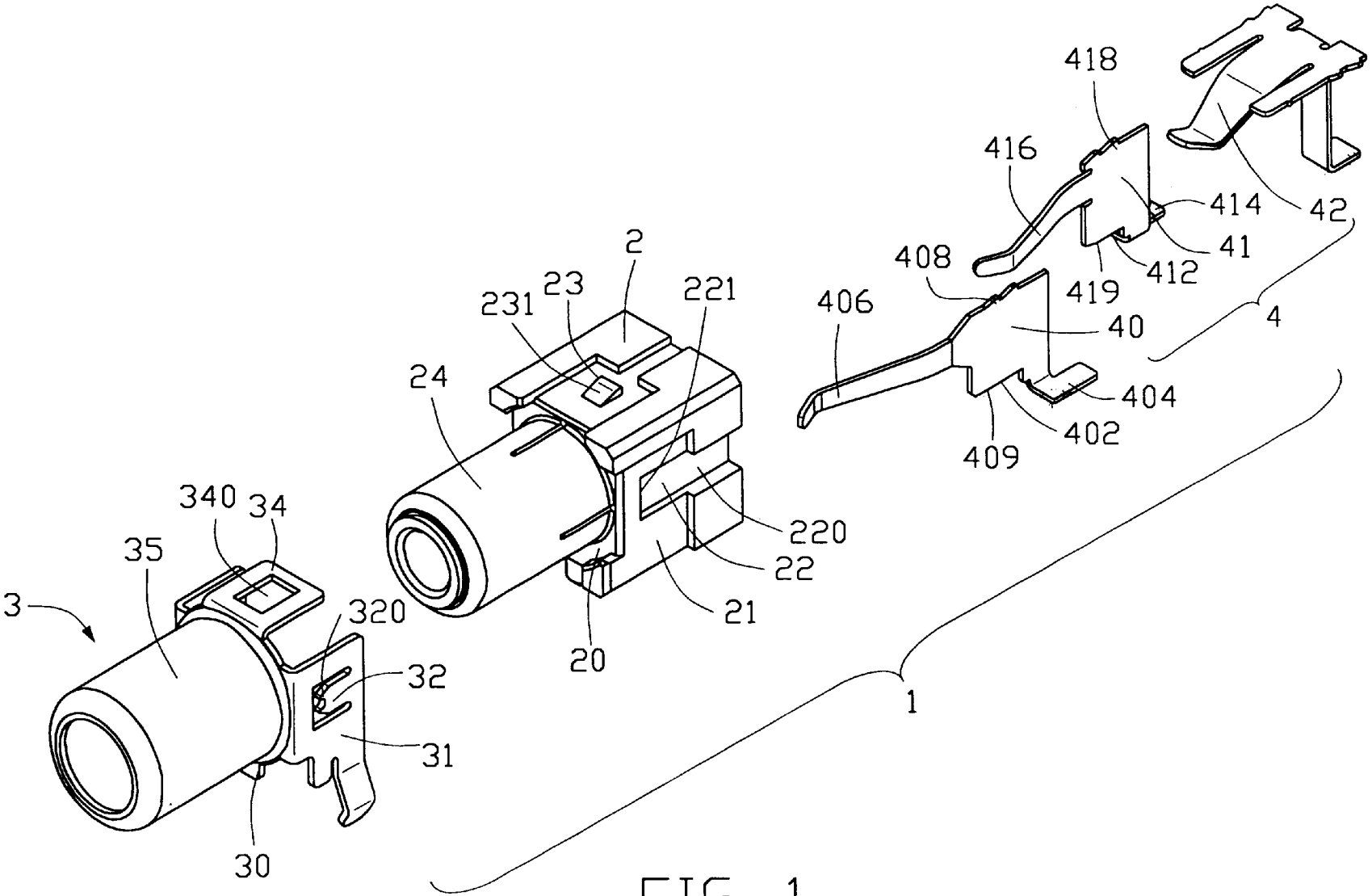
FIG. 1 is an exploded view of an electrical connector in accordance with the present invention.
Figure 2:
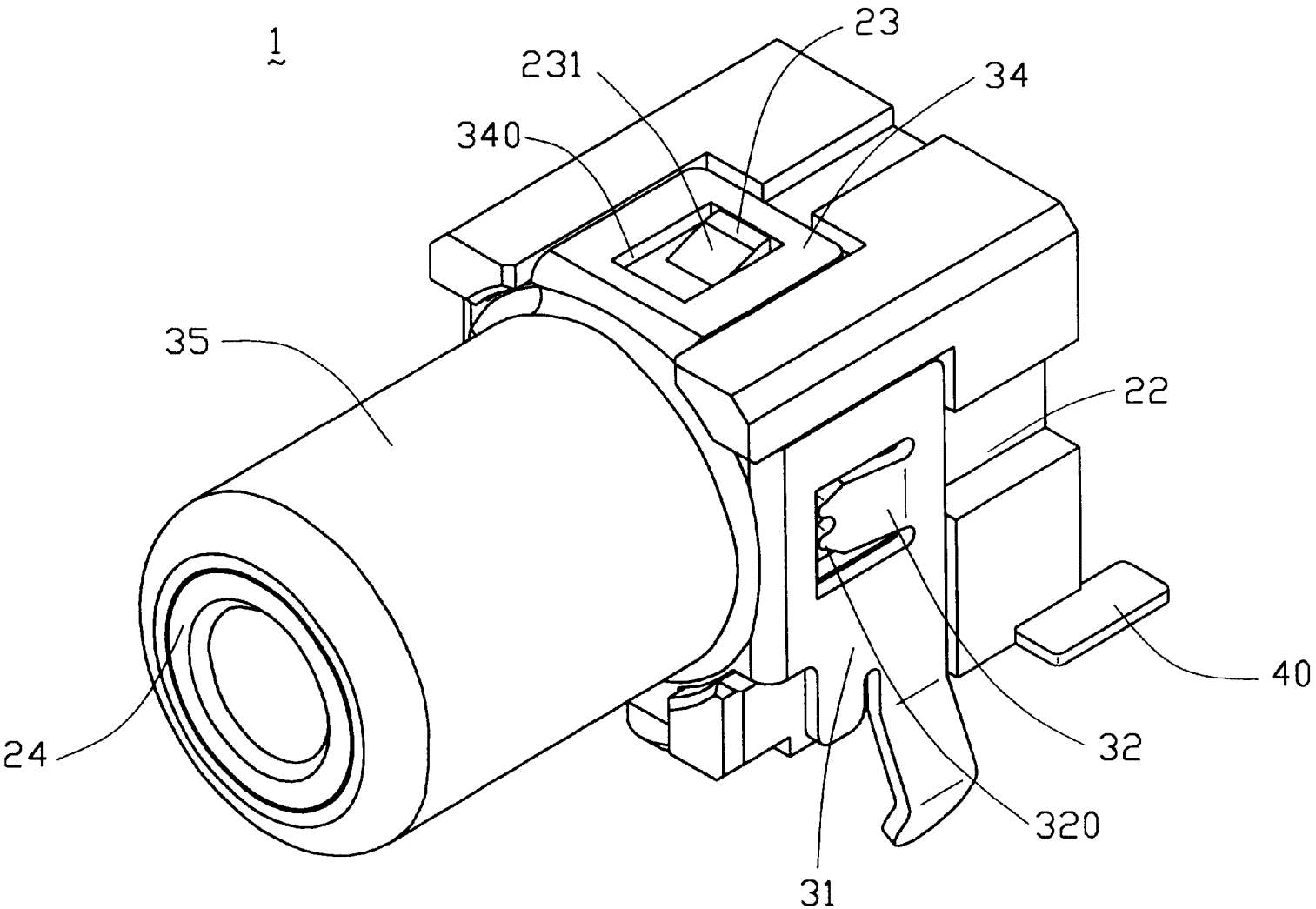
FIG. 2 is an assembled view of the electrical connector shown in FIG. 1.
Figure 3:
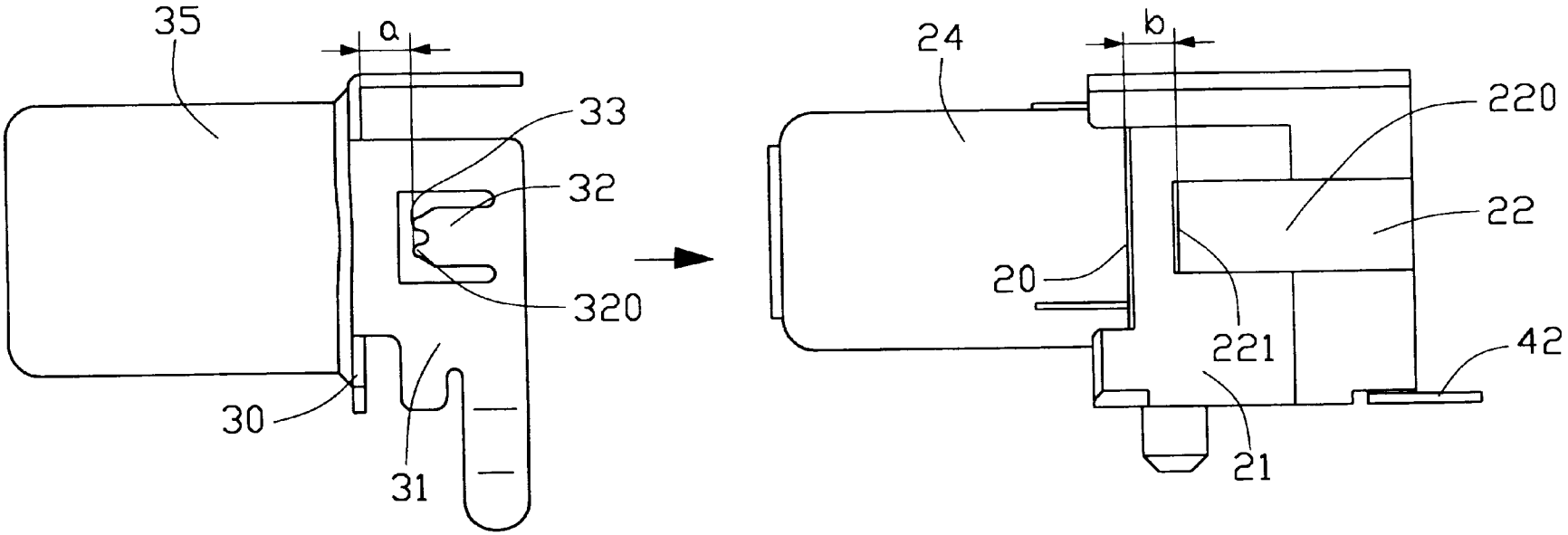
FIG. 3 is a side view showing the assembling process of the electrical connector shown in FIG. 2.
Figure 4A:
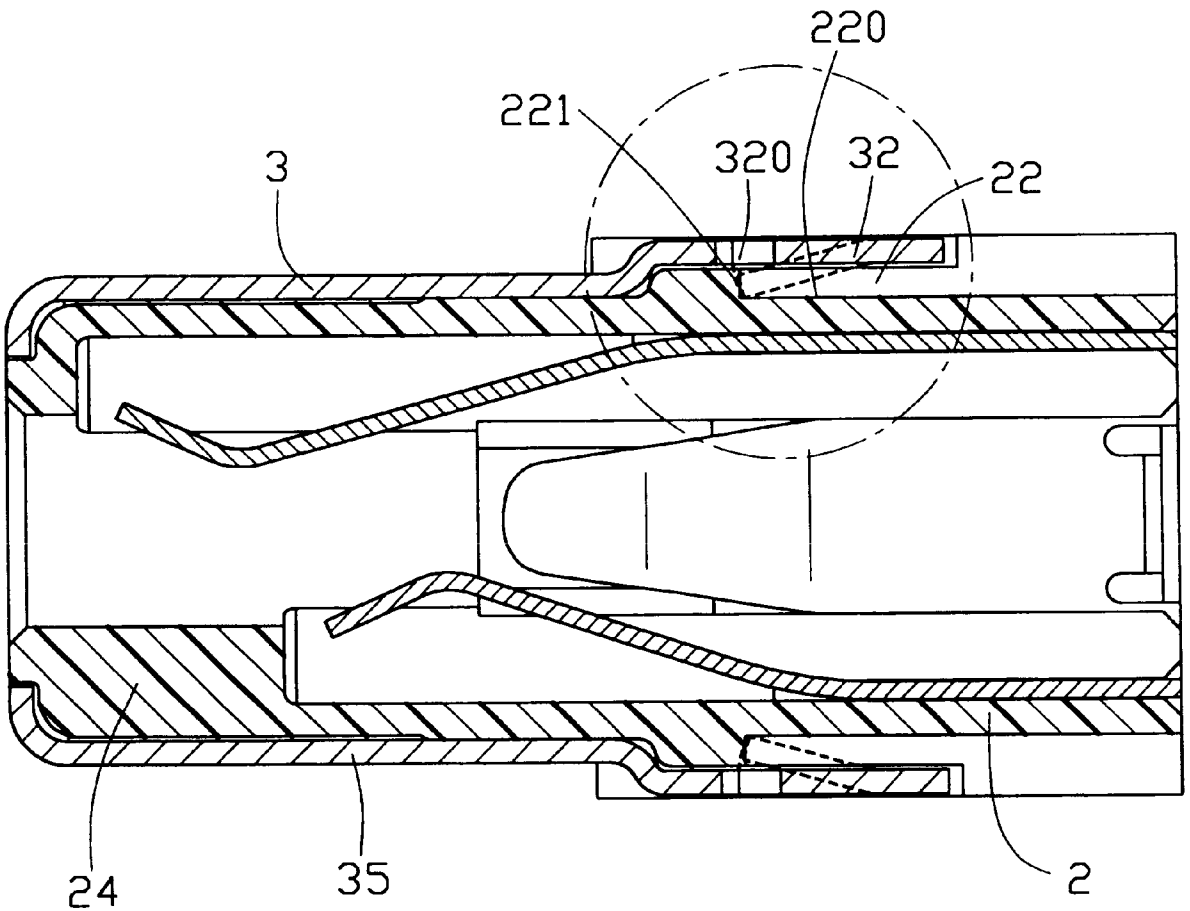
FIGS. 4A and 4B are a cross-sectional and a magnified fragmentary cross-sectional views of the electrical connector shown in FIG. 2, respectively.
Figure 4B:
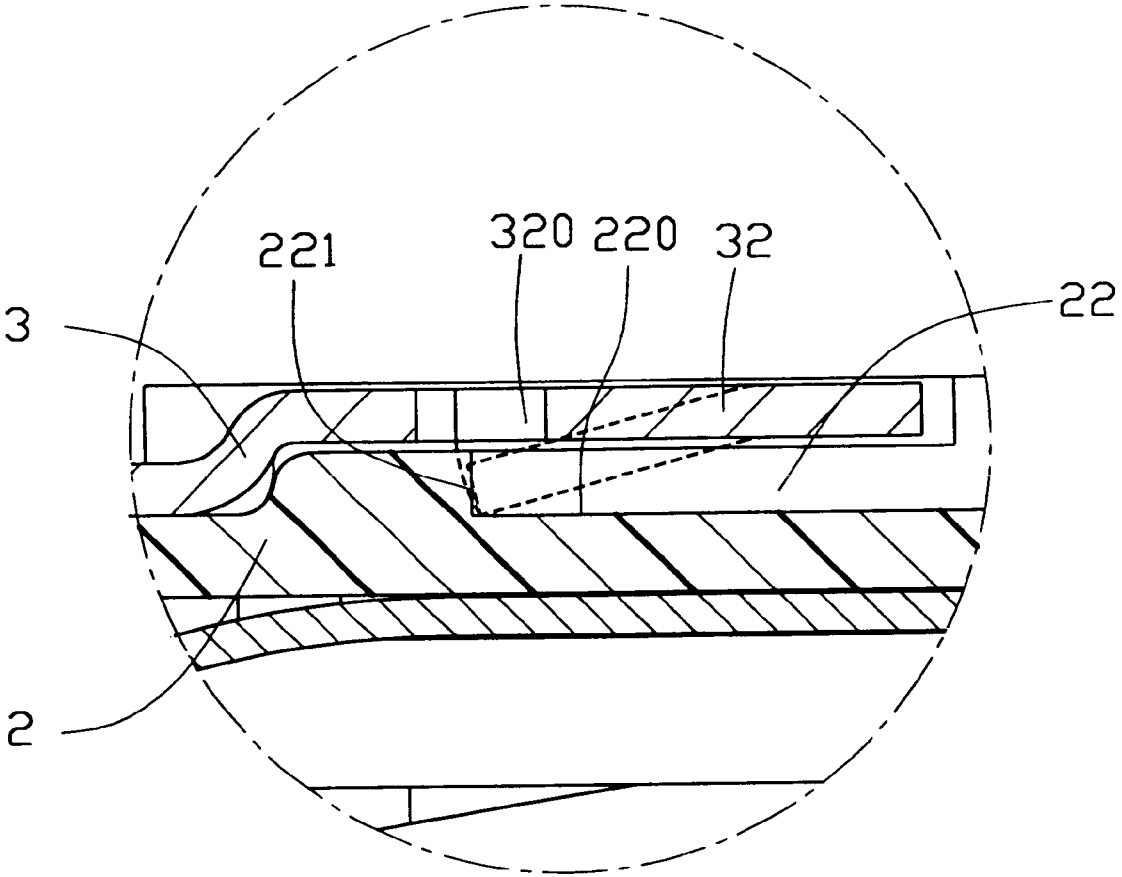
Figure 5:
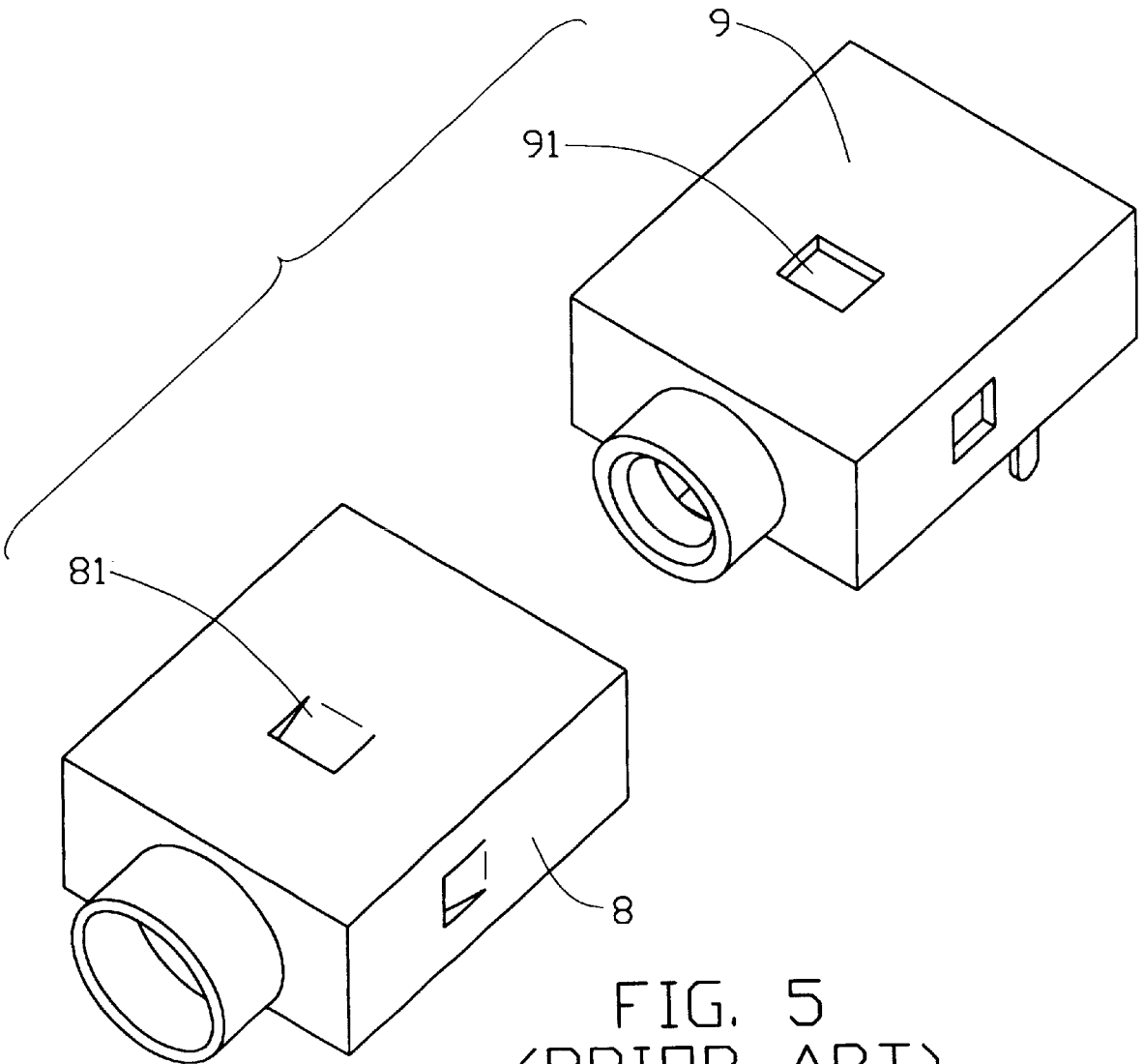
FIG. 5 (PRIOR ART)
FIG. 5 is an exploded view of a prior art electrical connector.
Figure 6B:
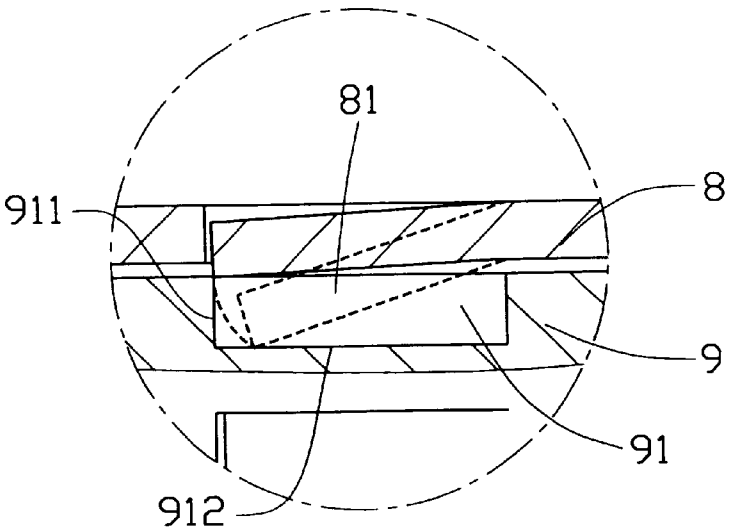
FIG. 6B (PRIOR ART)
FIGS. 6A and 6B are a cross-sectional and a magnified fragmentary cross-sectional views of the electrical connector shown in FIG. 5, respectively.
Figure 6A:
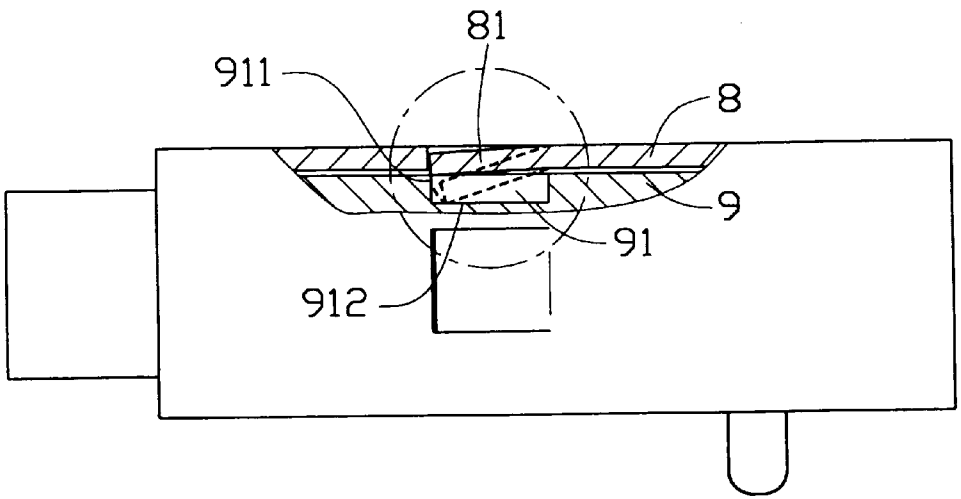
FIG. 6A (PRIOR ART)

Referring to FIG. 1, an electrical connector 1 in accordance with the present invention comprises an insulative housing 2, a shield 3 covering outside of the insulative housing 2, and a terminal group 4 received in the insulative housing 2. The insulative housing 2 comprises a main body 25 having a top wall 26, a bottom wall (not shown), a front surface 20, a pair of sidewalls 21, and a projecting portion 24 extending forwardly to receive a mating plug (not shown). Each sidewall 21 defines a recess 22, and the recess 22 defines a bottom face 220 and an inner wall 221 therein. A protrusion 23 projects from the top wall 26, and defines an incline 231 for guiding the shield 3.

The shield 3 comprises a front portion 35 projecting forwardly from a shield front surface 30 for receiving the projecting portion 24 of the insulative housing 2, a locking plate 34 extending rearwardly from a top edge of the shield front surface 30, and a pair of side plates 31 for cooperating with the sidewalls 21 of the insulative housing 2. An opening 340 is defined in the locking plate 34. A securing tab 32 is formed in each side plate 31, each securing tab 32 having a pair of tines 320 to engage with the recesses 22 of the insulative housing 2. A mounting leg (not labeled) extends downward from a bottom edge of each side plate for engagement with the printed circuit board on which the connector 1 is seated.

The terminal group 4 comprises a first terminal 40, a second terminal 41, and a third terminal 42. The first terminal 40 and the second terminal 41 comprise, respectively, a contacting portion 406, 416 for mating with a complementary plug (not shown), an engaging portion 402, 412 for retaining the terminal 40, 41 in the insulative housing 2, and a positioning portion 404, 414 for attaching the terminal 40, 41 to a board (not shown). The engaging portions 402, 412 further respectively define an upper edge 408, 418 and a lower flat edge 409, 419. The respective upper edge 408, 418 project from the engaging portions 402, 412 to interengage with the insulative housing 2, while the lower edges 409, 419 abut against the insulative housing 2 to maintaining coplanarity of the positioning portions 404, 414 during a succeeding SMT process. Thus, after assembly, the first terminal 40 and the second terminal 41 are stably retained in the insulative housing 2 respectively by the two edges 408 and 409, 418 and 419 of the engaging portions 402, 412 and can be reliably attached to the board (not shown).

In assembly, referring to FIGS. 2–4B, the terminal group 4 is inserted into the insulative housing 2, and the insulative housing 2 is inserted into the shield 3. The locking plate 34 slides up the incline 231 of the protrusion 23 of the insulative housing 2 until the opening 340 engages with the protrusion 23 to retain the shield 3 around the insulative housing 2, and the side plates 31 cover the sidewalls 21. The securing tabs 32 are engaged with the recesses 22 (see FIGS. 4A–4B) using a tool (not shown) so that the tines 320 are embedded into the inner walls 221 and the bottom faces 220 of the recesses 22. In other words, referring to FIG. 3, the distance "a" between a forward tip of the tines 320 and a rearward side of the shield front surface 30 is not more than the distance "b" between the inner walls 221 and the front surface 20. By this arrangement, the securing tabs 32 not only contact the bottom face 220, but also contact the inner wall 221 of the recesses 22. Thus the shield 3 more securely covers the insulative housing 2, and more reliably protects against EMI.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for receiving a plug, comprising:

an insulative housing having a pair of recesses in two side walls thereof, each recess defining an inner wall located at a front end thereof;

a group of terminals received in the insulative housing for electrically connecting with an inserted mating plug; and a shield covering a front of the insulative housing, the shield comprising a pair of side plates, each side plate having a securing tab, the securing tab having a tine projecting forwardly therefrom and embedded into a corresponding recess to engage with the inner wall of the insulative housing;

wherein each recess has a bottom face therein to engage with the tine of the corresponding securing tab;

wherein the terminal group comprises a first terminal, a second terminal, and a third terminal and each of the first terminal and the second terminal comprises an engaging portion retained in the insulative housing, a contacting portion for mating with a complementary plug, and a positioning portion for soldering to a printed circuit board;

wherein the engaging portion defines a serrated upper edge interengaging with the insulative housing and a lower flat edge abutting against the insulative housing to facilitate maintaining coplanarity of the positioning portions.

2. An electrical connector for receiving a plug, comprising:

an insulative housing defining a main body with a cylindrical projection portion extending forwardly therefrom, said main body defining a top wall and two opposite side walls, a protrusion formed on the top wall, and each side wall defining a recess with a bottom face and an inner wall located at a front end thereof; and a shield including a tubular front portion forwardly extending from a shield front surface, a locking plate extending rearwardly from a top edge of the shield front surface and latchably engaged with the protrusion on the top wall, and a pair of side plates spaced from the locking plate and extending rearwardly from two opposite side edges of the shield front surface, a securing tab formed in each of said side plates and latchably engaged within the corresponding recess to simultaneously abut against the corresponding inner wall and bottom face therebouts, said securing tab having a tine projecting forwardly therefrom, the distance between the inner wall and a rearward side of the shield front surface being greater than the distance between a forward tip of the tine and the rearward side of the shield front surface;

wherein each side plate further includes a mounting leg extending downwardly from a bottom edge thereof.

* * * * *